US005957291A

United States Patent [19]

Whitfield, Sr.

[11] Patent Number: 5,957,291

[45] Date of Patent: Sep. 28, 1999

[54] CUE STICK HOLDER

[76] Inventor: James A. Whitfield, Sr., 4945 Flamingo, Odessa, Tex. 79764

[21] Appl. No.: 09/039,995

[22] Filed: Mar. 17, 1998

[51] Int. Cl.[6] ..... B65D 69/00

[52] U.S. Cl. ..... 206/579; 206/315.1

[58] Field of Search ..... 206/315.1, 579; 211/68; 190/102

[56] References Cited

U.S. PATENT DOCUMENTS

| | | | |
|---|---|---|---|
| 4,968,048 | 11/1990 | Lortie | 206/315.1 |
| 5,255,799 | 10/1993 | Haynes | 211/68 |
| 5,845,780 | 12/1998 | Allen | 206/579 |

*Primary Examiner*—David T. Fidei

*Attorney, Agent, or Firm*—Theodore F. Shiells; Gardere & Wynne, LLP

[57] ABSTRACT

A cue stick holder is provided with at least one cue stick receiving aperture for maintaining a cue stick in an upright orientation. The cue stick receiving aperture may be either completely enclosed or partially enclosed. The cue stick holder is supported on a cue stick case for selective movement between a normally horizontal orientation wherein the cue stick receiving aperture is adapted to receive a cue stick therein and a storage orientation. Alternatively, the cue stick holder may comprise a cue stick receiving aperture and an adhesive layer or mechanical attachment for securing the cue stick holder at a desired location.

3 Claims, 8 Drawing Sheets

CUE STICK HOLDER

TECHNICAL FIELD

The present invention relates generally to billiards, pocket billiards, and other games played with cue sticks, and more particularly to a portable or case-mounted cue stick holder which is adapted to maintain a cue stick in an upright orientation in the immediate vicinity of the user.

BACKGROUND AND SUMMARY OF THE INVENTION

Billiards, pocket billiards, and similar games involving the use of cue sticks are played and enjoyed literally throughout the world. Frequent players often utilize cue sticks which are either custom-made or specially purchased to suit the requirements of the particular player. Obviously, the owner of a custom-made or specially purchased cue stick wants to keep such a prized possession in close proximity to assure that it is not lost, stolen, or damaged. Even occasional players prefer to keep a selected "house" cue stick close at hand for use throughout an entire game.

Billiard parlors and similar facilities almost universally provide racks for cue sticks. However, there is often an unacceptable distance between the cue stick rack and the table upon which the game is played such that returning cue sticks to the rack is both inconvenient and undesirable from the standpoint of maintaining the cue stick in close proximity. It is therefore considered to be highly desirable to provide a cue stick holder which allows the cue stick to be maintained in close proximity to its owner.

Various attempts at providing a cue stick holder owned and used solely by a particular owner have heretofore been proposed. Unfortunately, prior cue stick holders adapted to securely maintain a cue stick in the close proximity of its owner have been expensive to purchase, bulky and awkward to store, and cumbersome in use. Therefore, a need exists for a cue stick holder which is (a) readily adapted to securely maintain a cue stick in close proximity to its owner, and (b) economical to purchase and easy to use.

The present invention comprises a cue stick holder which fulfills the foregoing and other requirements long since found lacking in the prior art. In accordance with one aspect of the invention, a cue stick holder is mounted in a cue stick case of the type used to transport one or more cue sticks to and from venues in which billiards, pocket billiards, and other games involving the use of cue sticks are played. The cue stick holder is mounted on the cue stick case for selective movement between first and second orientations. In the first orientation the cue stick holder is deployed to securely maintain a cue stick in close proximity to its owner. In the second orientation the cue stick holder is stored to facilitate conventional use of the cue stick case. The cue stick holder may be mounted at any desired location on the cue stick case and may be supported either for sliding or for pivotal movement between its two orientations.

In accordance with another aspect of the invention, there is provided a portable cue stick holder adapted for mounting at any desired location. The portable cue stick holder may be secured in place by a suitable adhesive which is preferably releasable, Velcro® fasteners, screws or other mechanical fasteners, etc.

In accordance with another aspect of the invention, a disposable cue stick holder is provided. The disposable cue stick holder comprises a relatively stiff sheet of paper or similar material having a cue stick receiving aperture formed therethrough. An adhesive layer is provided along one edge of the disposable cue stick holder for use in securing the cue stick holder to a table, chair, etc. A plurality of disposable cue stick holders may be provided in padded form, and are adapted to storage on or in a cue stick case.

BRIEF DESCRIPTION OF DRAWINGS

A more complete understanding of the invention may be had by reference to the following Detailed Description when taken in conjunction with the accompanying Drawings, in which.

DETAILED DESCRIPTION

Figure 1:
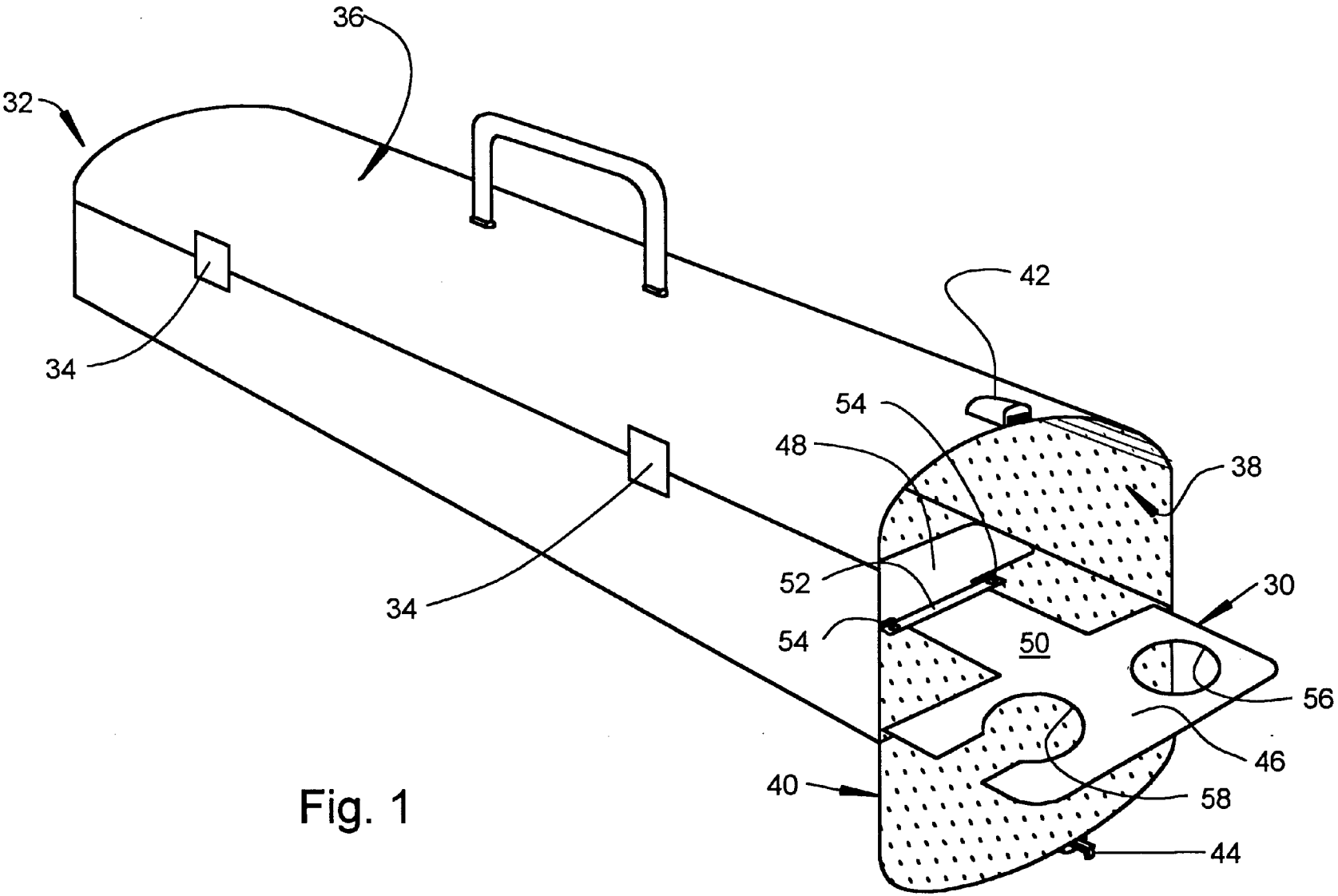
FIG. 1 is a perspective view of a cue stick holder comprising a first embodiment of the invention.

Referring now to the Drawings, and in particular to FIG. 1 thereof, there is shown a cue stick holder 30 comprising a first embodiment of the invention. The cue stick holder 30 is mounted on a cue stick case 32 which is conventional in construction and design. The cue stick case 32 may be provided with latches 34 which are normally closed and which are selectively operable to allow a top 36 of the case 32 to be pivoted about a longitudinal axis to expose the entire contents of the case 32. Alternatively, the latches 34 and the pivotal construction of the top 36 may be dispensed with, in which event access to the case 32 is gained entirely from one end thereof.

The cue stick case 32 has an openable end 38 and an end member 40 which may be secured in a closed configuration by cooperating latch members 42 and 44. Upon actuation of the latch members 42 and 44, the end member 40 is openable, whereupon the end member 40 pivots through an arc of 180° and extends downwardly relative to the remainder of the case 32 as shown in FIG. 1.

The cue stick holder 30 is mounted on the case 32 and comprises a cue stick receiving portion 46, a retainer portion 48, and a narrow portion 50 extending between the cue stick receiving portion 46 and the retaining portion 48. A retainer 52 is mounted on the case 32 and is secured by fasteners 54. The retainer 52 extends over the narrow portion 50 of the cue stick holder 30 to facilitate sliding movement of the cue stick holder 30 between two orientations.

In its first orientation, the cue stick holder 30 is extended as shown in FIG. 1 and is thus adapted to receive cue sticks through apertures 56 and 58. The aperture 56 is closed around its entire periphery and thereby provides more secure cue stick retention. The aperture 58 is open at one side and therefore may be considered to be more convenient to use. Either type of aperture may be employed in conjunction with the invention in accordance with the requirements of particular applications thereof.

In its second orientation, the cue stick holder 30 is moved inwardly relative to the case 32 until the cue stick receiving portion 46 thereof is entirely contained inside the cue stick case 32. In this orientation the cue stick holder 30 is positioned to permit conventional use of the cue stick case 32. The end member 40 is then pivoted upwardly and is secured in the closed orientation by the latch members 42 and 44. This facilitates the use of the cue stick case 32 for the transportation and storage of cue sticks.

In the use of the cue stick holder 30, the cue stick case 32 is positioned on a table or other supporting structure in the immediate vicinity of the owner of the case 32 and the cue sticks contained therein. The latch members 42 and 44 are actuated to facilitate opening of the end member 40, whereupon the end member 40 is pivoted downwardly into the orientation illustrated in FIG. 1. The cue stick holder 30 is then moved outwardly into the orientation shown in FIG. 1, wherein the cue stick holder 30 is adapted to receive and securely maintain cue sticks in an upright orientation and in the immediate vicinity of the owner.

Figure 2:
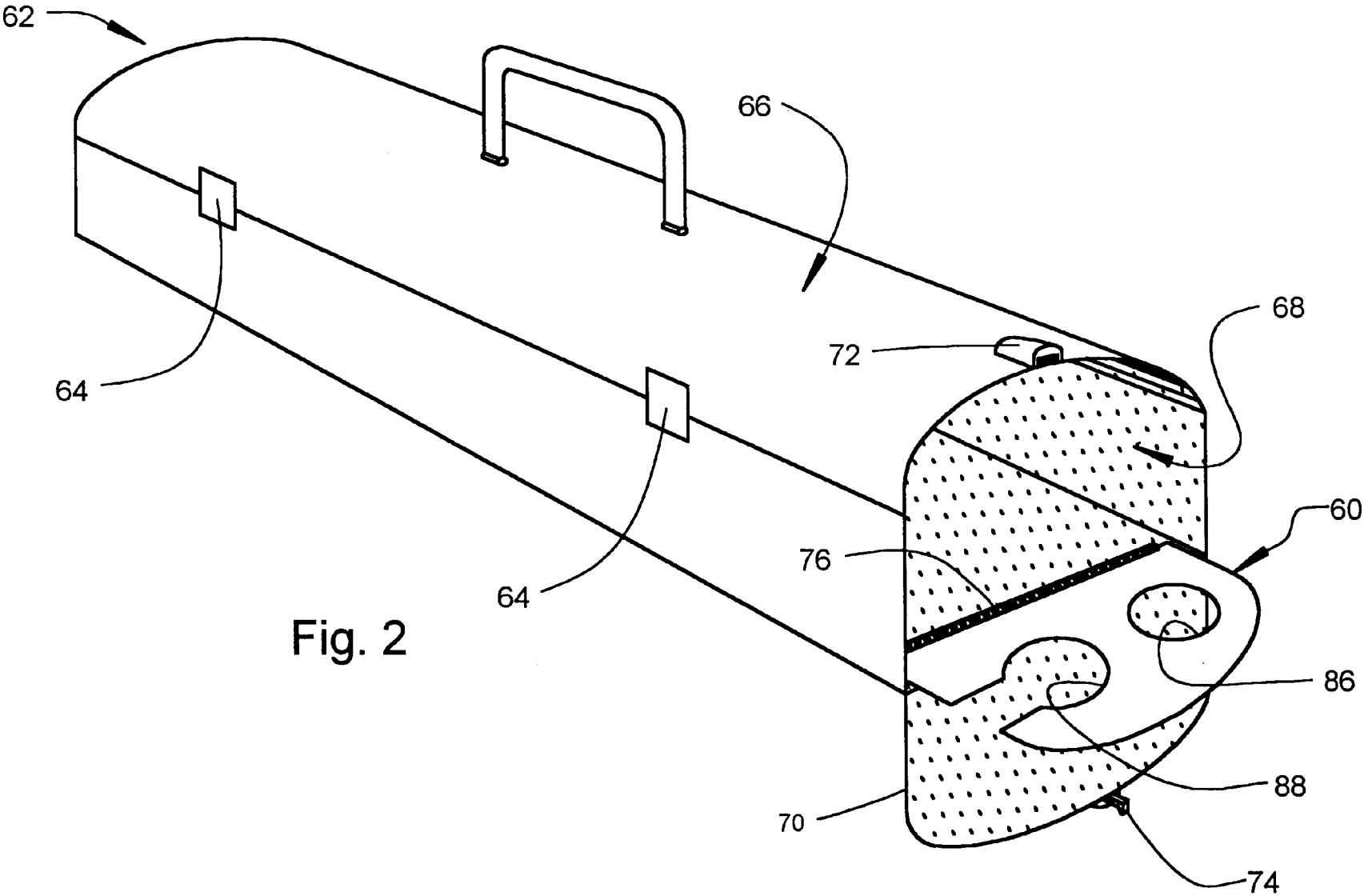
FIG. 2 is a perspective view of a cue stick holder comprising a second embodiment of the invention.

Referring now to FIG. 2 thereof, there is shown a cue stick holder 60 comprising a second embodiment of the invention. The cue stick holder 60 is mounted on a cue stick case 62 which is conventional in construction and design. The cue stick case 62 may be provided with latches 64 which are normally closed and which are selectively operable to allow a top 66 of the case 62 to be pivoted about a longitudinal axis to expose the entire contents of the case 62. Alternatively, the latches 64 and the pivotal construction of the top 66 may be dispensed with, in which event access to the case 62 is gained entirely from one end thereof.

The cue stick case 62 has an openable end 68 and an end member 70 which may be in a closed configuration by cooperating latch members 72 and 74. Upon actuation of the latch member 72 and 74, the end member 70 is openable, whereupon the end member 70 pivots through an arc of 180° and extends downwardly relative to the remainder of the case 62.

The cue stick holder 60 is mounted on the case 62 and is supported for pivotal movement with respect thereto by a hinge 76. Thus, the cue stick holder 60 is adapted for pivotal movement between first and second orientations.

In its first orientation, the cue stick holder 60 is extended as shown in FIG. 2 and is thus adapted to receive cue sticks through apertures 86 and 88. The aperture 86 is closed around its entire periphery and thereby provides more secure cue stick retention. The aperture 88 is open at one side and therefore may be considered to be more convenient to use. Either type of aperture may be employed in conjunction with the invention in accordance with the requirements of particular applications thereof.

In its second orientation, the cue stick holder 60 is pivoted upwardly relative to the case 62 until the cue stick holder 60 is entirely contained inside the cue stick case 62. In this orientation the cue stick holder 60 is positioned to permit conventional use of the cue stick case 62. The end member 70 is then pivoted upwardly and is secured in the closed orientation by the latch members 72 and 74. This facilitates the use of the cue stick case 62 for the transportation and storage of cue sticks.

Figure 3:
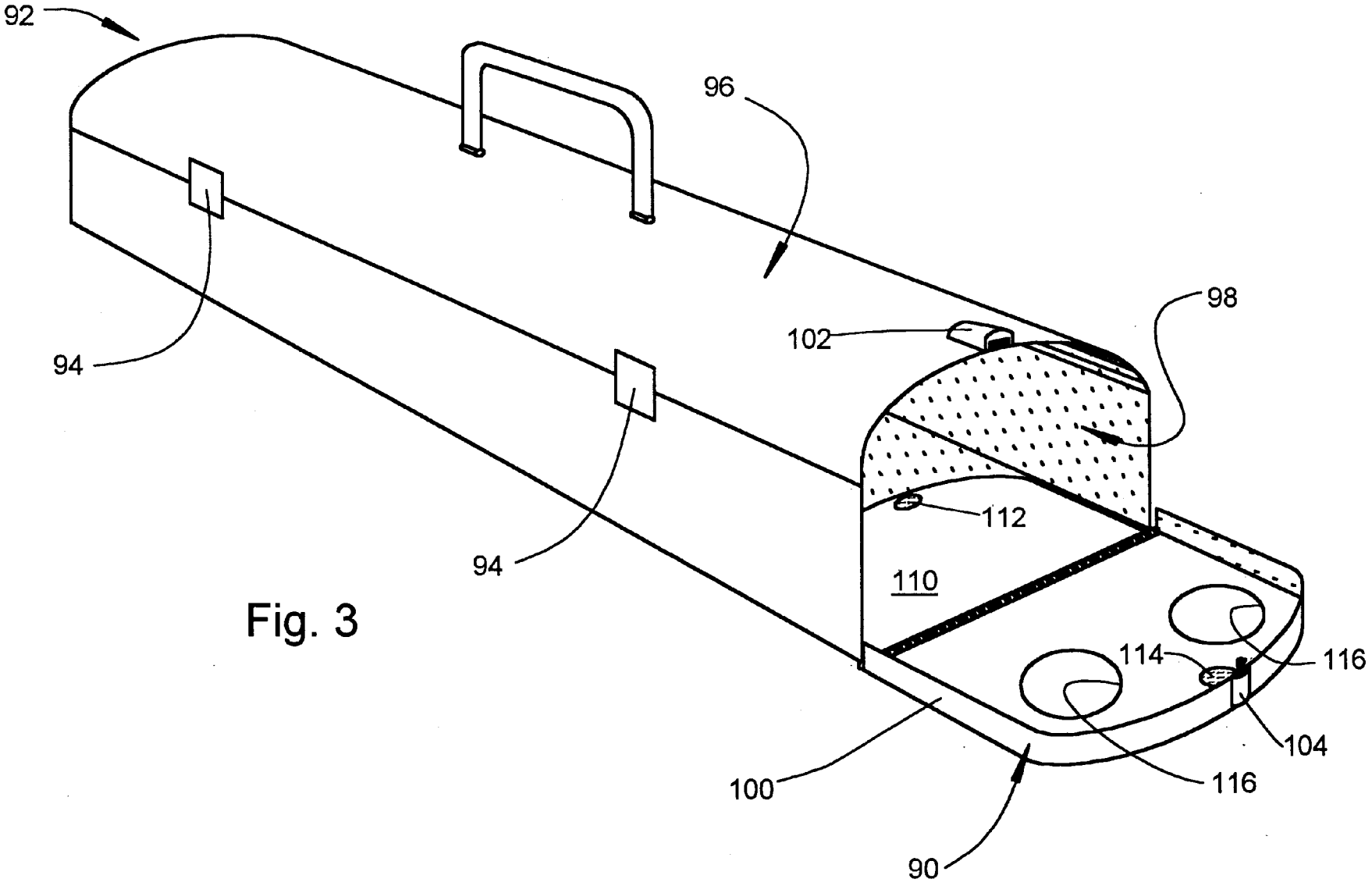
FIG. 3 is a perspective view of a cue stick holder comprising a third embodiment of the invention.

In the use of the cue stick holder 60, the cue stick case 62 is positioned on a table or other supporting structure in the immediate vicinity of the owner of the case 62 and the cue sticks contained therein. The latch members 72 and 74 are actuated to facilitate opening of the end member 70, whereupon the end member 70 is pivoted downwardly into the orientation illustrated in FIG. 1. The cue stick holder 60 is then pivoted downwardly into the orientation shown in FIG. 2, wherein the cue stick holder 60 is adapted to receive and securely maintain cue sticks in the immediate vicinity of the owner. Referring now to FIG. 3 thereof, there is shown a cue stick holder 90 comprising a third embodiment of the invention. The cue stick holder 90 is mounted on a cue stick case 92 which is conventional in construction and design. The cue stick case 92 may be provided with latches 94 which are normally closed and which are selectively operable to allow a top 96 of the case 92 to be pivoted about a longitudinal axis to expose the entire contents of the case 92. Alternatively, the latches 94 and the pivotal construction of the top 96 may be dispensed with, in which event access to the case 92 is gained entirely from the end thereof.

The cue stick case 92 has an openable end 98 and an end member 100 which may be secured in a closed configuration by cooperating latch members 102 and 104. Upon actuation of the latch member 102 and 104, the end member 100 is openable, whereupon the end member 100 pivots through an arc of 90° and extends outwardly relative to the remainder of the case 92 as shown in FIG. 3.

In its first orientation, the cue stick holder 90 is extended as shown in FIG. 3 and is adapted to receive cue sticks through apertures 116 when the cue stick holder 90 is pivoted upwardly relative to the case 92 it is positioned to permit conventional use of the cue stick case 92. The cue stick holder 90 is secured in the closed orientation by the latch members 102 and 104. If desired, a pivotally supported closure plate 110 may be secured to that cue stick holder 90 by means of fasteners 112 and 114 to cover the apertures 116 and 118.

In the use of the cue stick holder 90, the cue stick case 92 is positioned on a table or other supporting structure in the immediate vicinity of the owner of the c 92 and the cue sticks contained therein. The latch members 102 and 104 are actuated to facilitate opening of the cue stick holder 90, whereupon the cue stick holder 90 is pivoted downwardly into the orientation illustrated in FIG. 3, wherein the cue stick holder 90 is adapted to receive and securely maintain cue sticks in an upright orientation and in the immediate vicinity of the owner.

Figure 4:
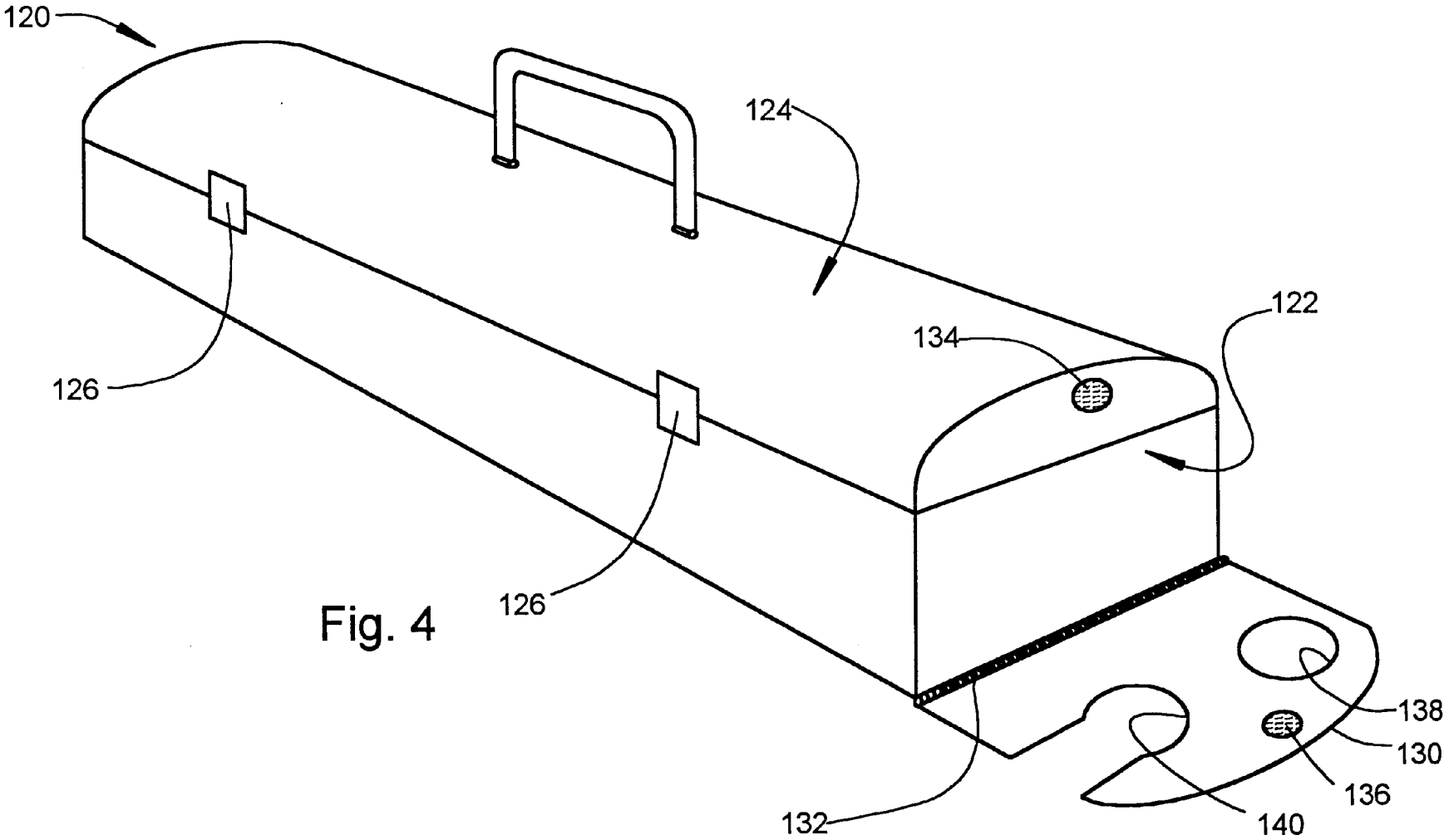
FIG. 4 is a perspective view of a cue stick holder comprising a fourth embodiment of the invention.

Referring now to FIG. 4, there is shown a cue stick case 120 having a closed end 122. The cue stick case 120 has an openable top 124 which is normally secured in the closed condition by latches 126. It will be understood that the present invention is equally applicable to other types of cue stick cases having other types of access mechanisms.

A cue stick holder 130 is mounted at the closed end 122 of the cue stick case 120 and is supported for pivotable movement about a normally horizontally disposed axis by a hinge 132. The hinge 132 may be of the snap-type; that is, the hinge 132 may be adapted to selectively position the cue stick holder 130 either in the position shown in FIG. 4 wherein the cue stick holder 130 is deployed to receive cue sticks or in a storage position wherein the cue stick holder 130 extends parallel to and engages the closed end 122 of the cue stick case 120.

The cue stick holder 130 and the cue stick case 120 are provided with cooperating members 134 and 136, respectively, which are adapted to secure the cue stick holder 130 in the storage orientation. The securing members 134 and 136 may comprise the hook and loop-type fastener which is sold under the trademark Velcro®. Alternatively, the securing members 134 and 136 may comprise conventional snap fasteners. Other conventional fastener types may also be utilized to secure the cue stick holder 130 in the storage position depending upon the requirements of particular applications of the invention.

In the use of the embodiment of the invention illustrated in FIG. 4, the cue stick case 120 is supported on a table or similar surface. The securing members 134 and 136 are disengaged and the cue stick holder 130 is pivoted downwardly into the operative orientation illustrated in FIG. 4. The cue stick holder 130 comprises one or more apertures adapted to receive and support a cue stick in an upright orientation. The aperture of the cue stick holder 130 may comprise either a fully enclosed aperture 138 or a partially enclosed aperture 140, or both. The use of the fully enclosed aperture 138 is advantageous in that it more securely maintains a cue stick in an upright orientation and is therefore more likely to prevent damage to the cue stick. The use of the partially enclosed aperture 140 is advantageous in that it simplifies the positioning of a cue stick therein.

Figures 5, 6:
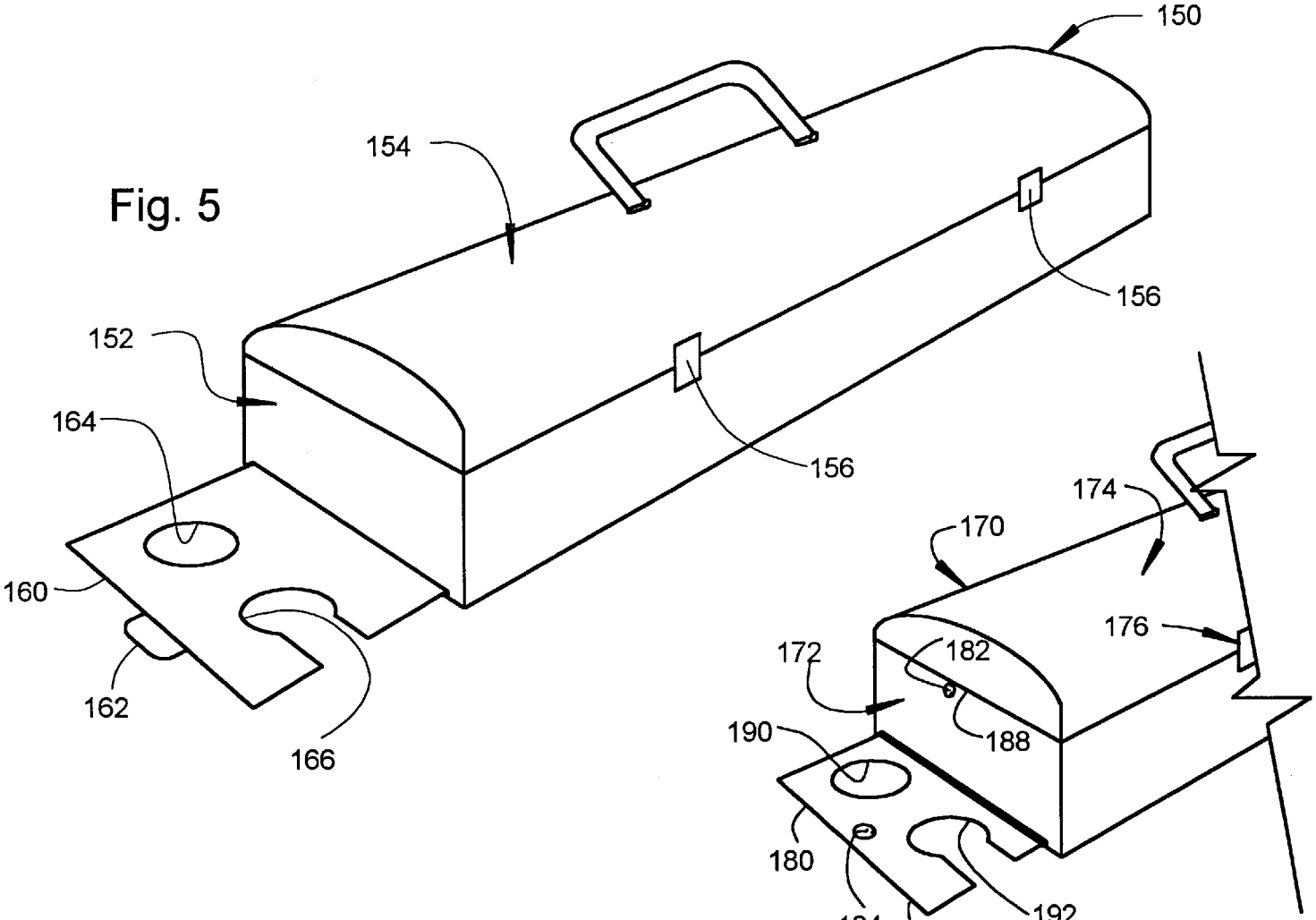
FIG. 5 is a perspective view of a cue stick holder comprising a fifth embodiment of the invention.
FIG. 6 is a perspective view of a cue stick holder comprising a sixth embodiment f the invention.

Referring to FIG. 5, there is shown a cue stick case 150 having a closed end 152. The cue stick case 150 has an upper portion or lid 154 which is pivotally supported to provide access to the interior of the cue stick case 150. The lid 154 is normally secured in the closed condition by a plurality of latches 156. It will be understood that the present invention is applicable to other types of cue stick cases having other access arrangements.

A cue stick holder 160 is mounted at the end or side 152 of the cue stick case 150 for sliding movement inwardly and outwardly relative to the cue stick case 150. A tab 162 may be provided at the distal end of the cue stick holder 160 for use in sliding the cue stick holder 160 inwardly and outwardly relative to the cue stick case 150. Other arrangements for providing access to the cue stick holder 160 to effect sliding movement thereof may also be utilized in the practice of the invention.

In use, the cue stick case 150 is positioned on a table or other surface. During transportation of cue sticks within the cue stick case 150, the cue stick holder 160 is normally retained in the storage position wherein it is entirely contained within the cue stick case 150 except for the tab 162 which may project slightly outwardly from the wall 152. In use, the cue stick holder 160 is slid outwardly from the cue stick case 150 into the orientation illustrated in FIG. 5, whereupon the cue stick holder 160 is adapted to receive cue sticks therein and to securely support the received cue sticks in an upright orientation.

The cue stick holder 160 comprises one or more cue stick receiving apertures. The cue stick receiving apertures of the cue stick holder 160 may comprise either fully enclosed apertures 164 or partially enclosed apertures 166, or both. The use of fully enclosed apertures is advantageous in that cue sticks are more securely retained therein, which in turn provides a higher level of assurance that the cue stick will not be damaged. The use of a partially enclosed cue stick receiving aperture is advantageous in that it more readily receives a cue stick therein.

Referring to FIG. 6, there is shown a cue stick case 170 having a closed end 172. The cue stick case 170 has an upper portion or lid 174 which is pivotally supported to provide access to the interior of the cue stick case 170. The lid 174 is normally secured in the closed condition by a plurality of latches 176. It will be understood that the present invention is applicable to other types of cue stick cases having other access arrangements.

A cue stick holder 180 is mounted at the end 172 of the cue stick case 170 for pivotal movement relative to the cue stick case 170. In one orientation the cue stick holder 180 extends outwardly as shown in FIG. 6 and is thus positioned to receive and support one or more cue sticks. In its second orientation the cue stick holder 180 extends parallel to the wall 172 and is secured by conventional fasteners 182 and 184. When the cue stick holder 180 is in the second orientation the distal end 186 thereof is coincident with the lower edge 188 of the lid 174. Thus, the cue stick holder 180 does not interfere with conventional usage of the cue stick case 170.

In use, the cue stick case 170 is positioned on a table or other surface. During transportation of cue sticks within the cue stick case 170, the cue stick holder 180 is normally retained in the storage position by the fasteners 182 and 184. In use, the cue stick holder 180 is pivoted downwardly relative to the cue stick case 170 into the orientation illustrated in FIG. 6, whereupon the cue stick holder 180 is adapted to receive cue sticks therein and to securely support the received cue sticks in an upright orientation.

The cue stick holder 180 comprises one or more cue stick receiving apertures. The cue stick receiving apertures of the cue stick holder 180 may comprise either fully enclosed apertures 190 or partially enclosed apertures 192, or both. The use of fully enclosed apertures is advantageous in that cue sticks are more securely retained therein, which in turn provides a higher level of assurance that the cue stick will not be damaged. The use of a partially enclosed cue stick receiving aperture is advantageous in that it more readily receives a cue stick therein.

Figures 7, 8:
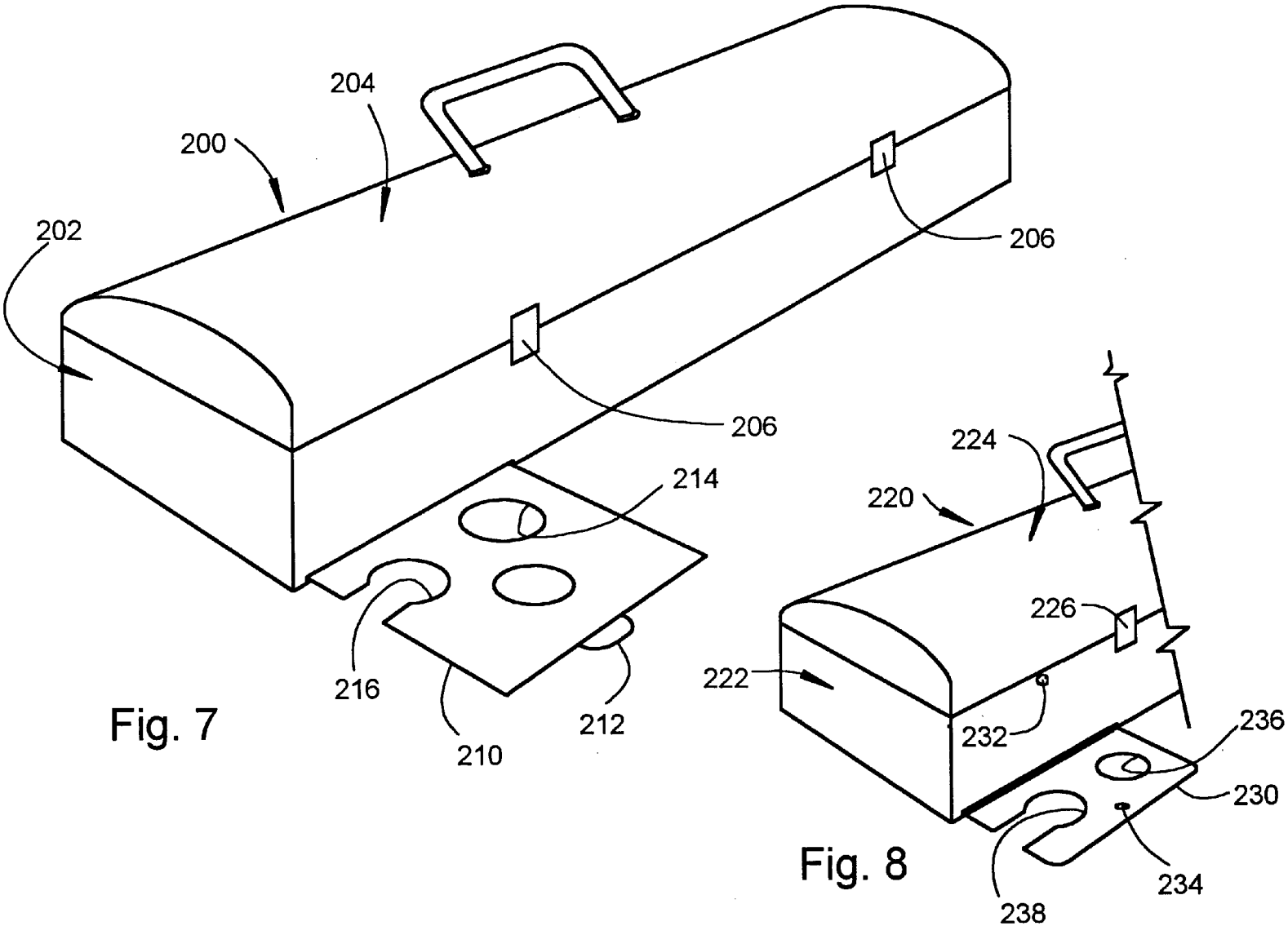
FIG. 7 is a perspective view of a cue stick holder comprising a seventh embodiment of the invention.
FIG. 8 is a perspective view of a cue stick holder comprising an eighth embodiment of the invention.

Referring to FIG. 7, there is shown a cue stick case 200 having a closed end 202. The cue stick case 200 has an upper portion or lid 204 which is pivotally supported to provide access to the interior of the cue stick case 200. The lid 204 is normally secured in the closed condition by a plurality of latches 206. It will be understood that the present invention is applicable to other types of cue stick cases having other access arrangements.

A cue stick holder 210 is mounted at the end 202 of the cue stick case 200 for sliding movement inwardly and outwardly relative to the cue stick case 200. A tab 212 may be provided at the distal end of the cue stick holder 210 for use in sliding the cue stick holder 210 inwardly and outwardly relative to the cue stick case 200. Other arrangements for providing access to the cue stick holder 180 to effect sliding movement thereof may also be utilized in the practice of the invention.

In use, the cue stick case 200 is positioned on a table or other surface. During transportation of cue sticks within the cue stick case 200, the cue stick holder 210 is normally retained in the storage position wherein it is entirely contained within the cue stick case 210 except for the tab 212 which may project slightly outwardly from the wall 202. In use, the cue stick holder 210 is slid outwardly from the cue stick case 200 into the orientation illustrated in FIG. 7, whereupon the cue stick holder 210 is adapted to receive cue sticks therein and to securely support the received cue sticks in an upright orientation.

The cue stick holder 180 comprises one or more cue stick receiving apertures. The cue stick receiving apertures of the cue stick holder 210 may comprise either fully enclosed apertures 214 or partially enclosed apertures 216, or both. The use of fully enclosed apertures is advantageous in that cue sticks are more securely retained therein, which in turn provides a higher level of assurance that the cue stick will not be damaged. The use of a partially enclosed cue stick receiving aperture is advantageous in that it more readily receives a cue stick therein.

Referring to FIG. 8, there is shown a cue stick case 220 having a closed end 222. The cue stick case 220 has an upper portion or lid 224 which is pivotally supported to provide access to the interior of the cue stick case 220. The lid 224 is normally secured in the closed condition by a plurality of latches 226. It will be understood that the present invention is applicable to other types of cue stick cases having other access arrangements.

A cue stick holder 230 is mounted at the end 222 of the cue stick case 220 for pivotal movement upwardly and downwardly relative to the cue stick case 170. In its first orientation as illustrated in FIG. 8, the cue stick holder is adapted to receive and support cue sticks. In its second orientation the cue stick holder extends parallel to the side wall of the cue stick case 220 and is secured in place by conventional fasteners 232 and 234.

In use, the cue stick case 220 is positioned on a table or other surface. During transportation of cue sticks within the cue stick case 220, the cue stick holder 230 is normally retained in the storage orientation wherein it is retained by the fasteners 232 and 234. In use, the cue stick holder 230 is pivoted downwardly from the cue stick case 220 into the orientation illustrated in FIG. 8, whereupon the cue stick holder 230 is adapted to receive cue sticks therein and to securely support the received cue sticks in an upright orientation.

The cue stick holder 230 comprises one or more cue stick receiving apertures. The cue stick receiving apertures of the cue stick holder 180 may comprise either fully enclosed apertures 236 or partially enclosed apertures 238, or both. The use of fully enclosed apertures is advantageous in that cue sticks are more securely retained therein, which in turn provides a higher level of assurance that the cue stick will not be damaged. The use of a partially enclosed cue stick receiving aperture is advantageous in that it more readily receives a cue stick therein.

Those skilled in the art will appreciate the fact that although the cue stick holders and the apertures thereof illustrated in FIGS. 1 through 8, inclusive, are quite utilitarian in appearance, cue stick holders comprising the present invention are adapted to a wide variety of design configurations. Thus, the cue stick receiving apertures and the cue stick holders themselves can take the form of letters of the alphabet, numerals, geometric configurations, astrological configurations, and any number of fanciful shapes. In sum, cue stick holders constructed in accordance with the present invention and the apertures thereof can be customized to suit the requirements of particular applications of the invention.

Figure 9:
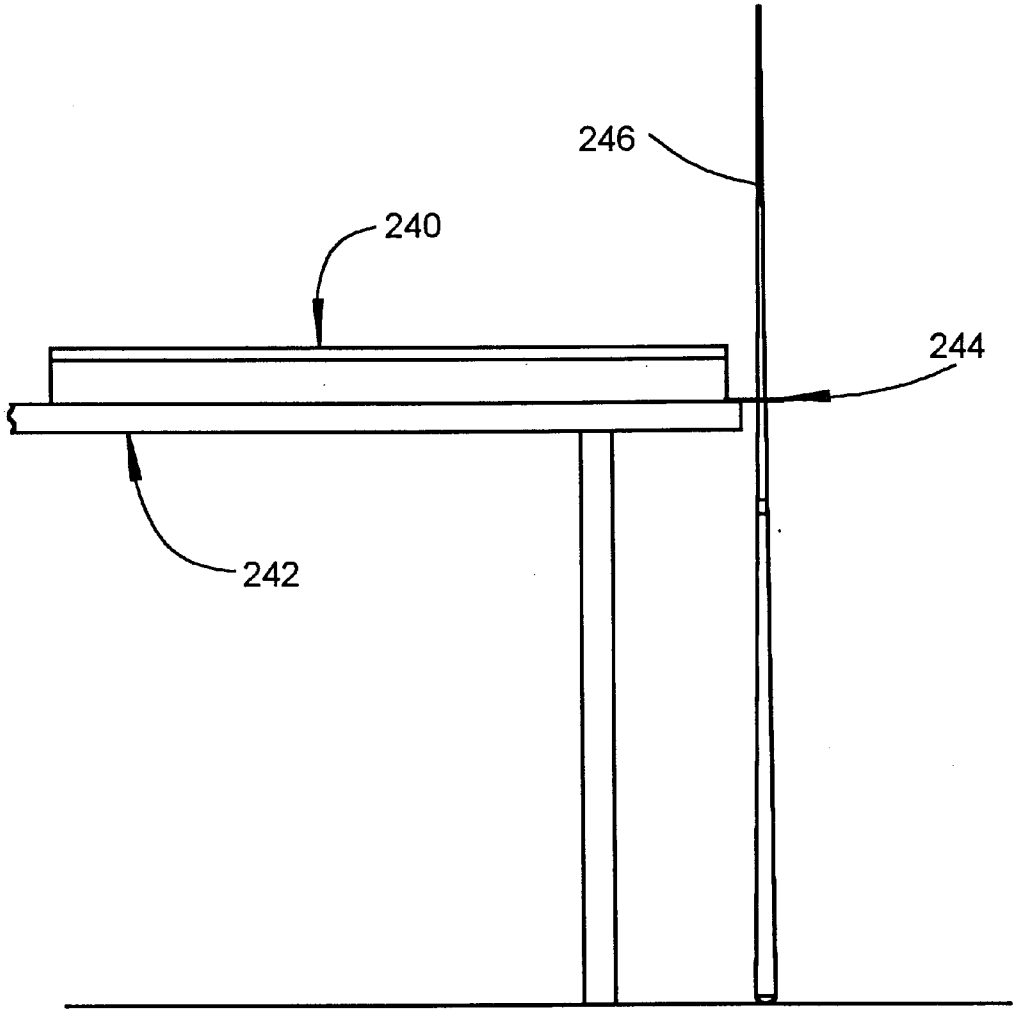
FIG. 9 is an illustration of the implementation of the first eight embodiments of that invention.

The implementation of the embodiments of the invention illustrated in FIGS. 1 through 8, inclusive, and described hereinabove in connection therewith is illustrated in FIG. 9. An otherwise conventional cue stick case 240 is supported on a table 242 in close proximity to the owner of the cue stick case and the cue sticks contained therein. A cue stick holder 244 constructed in accordance with the present invention is deployed in its operative orientation, that is, the cue stick holder 244 is deployed horizontally and extended beyond the end of the table 242. A cue stick 246 is received in an aperture comprising the cue stick holder 244 and is maintained by the cue stick holder 244 in an upright orientation. Thus, the cue stick 246 is secured against damage, loss or theft and in a location closely adjacent to its owner.

Figure 10:
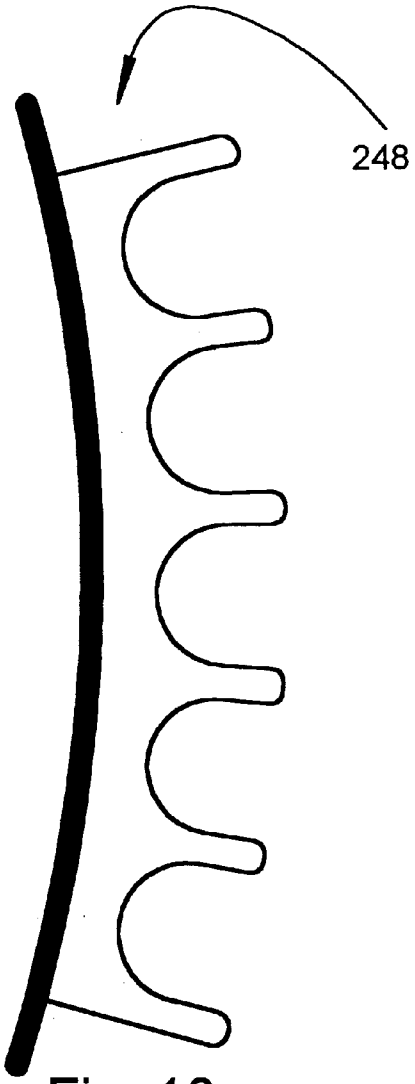
FIG. 10 is an illustration of a cue stick holder comprising a ninth embodiment of the invention.

The present invention may take the form of a portable cue stick holder 248 such as that illustrated in FIG. 10. The portable cue stick holder 248 may have a flat rear surface for application to a wall, or other flat surface. Alternatively, the portable cue stick holder 248 may have a curved rear surface for application to a table, chair back, etc. The portable cue stick holder 248 may be secured in place by a releasable adhesive, a hook and loop type fastener of the type sold under the trademark Velcro®, screws or other mechanical fasteners, etc.

Figure 11:
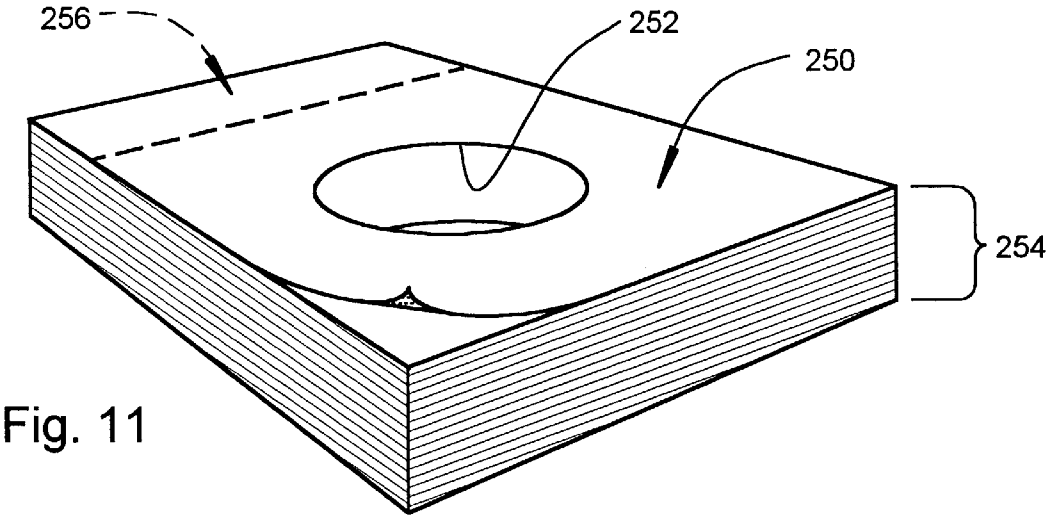
FIG. 11 is perspective view of a cue stick holder comprising a ninth embodiment of the invention.
Figure 12:
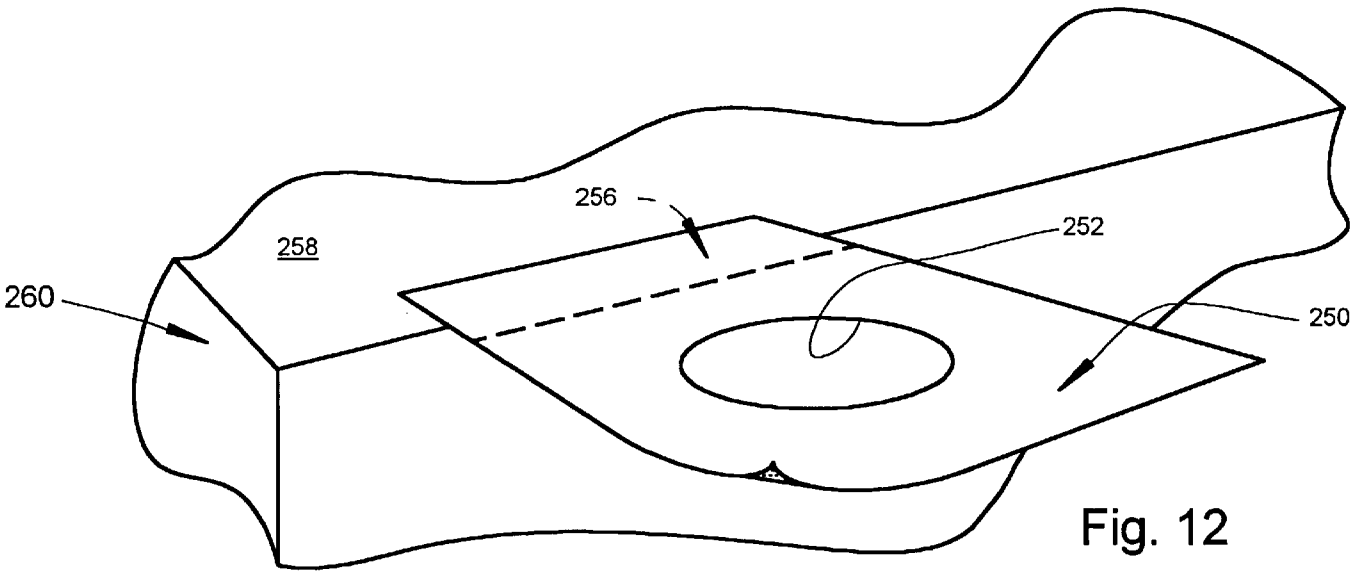
FIG. 12 is an illustration of the implementation of the tenth embodiment of the invention.

Referring to FIGS. 11 and 12, there is illustrated an embodiment of the invention which differs considerably from those of FIGS. 1 through 8. A plurality of cue stick holders 250 each having a cue stick receiving aperture 252 extending there through are provided in a form of a pad 254 similar to a pad of Post-it® Notes. Each cue stick holder 250 is formed from paper or the like and has a rigidity somewhat greater than that of a conventional Post-it® Notes sheet, for example, two conventional Post-it® Notes sheets secured together may be utilized in the practice in the invention. Each of the cue stick holders 250 has a layer of glue or adhesive 254 formed on the reverse side thereof, the formulation and function of the adhesive layer 254 being identical to that of the adhesive layer of Post-it® Notes.

Implementation of the embodiment of the invention illustrated in FIG. 11 is illustrated in FIG. 12. One of the cue stick holders 250 from pad 254 is withdrawn from the pad in the conventional manner and is adhesively secured to the top 258 of a table 260, chair, or similar article. By this means the cue stick holder 250 is disposed horizontally and is adapted to receive a cue stick in the aperture 252 thereof. In actual practice it has been determined that a cue stick holder of the type illustrated in FIGS. 11 and 12 can retain a cue stick in an upright orientation for several days without being replaced. As will be appreciated, after a particular cue stick holder 250 has been utilized it is simply discarded in the same manner as other paper-type trash.

Although preferred embodiments of the invention illustrated in the company Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. Apparatus for securing a cue stick in an upright orientation comprising:

a cue stick case for receiving and transporting one or more cue sticks therein;

a cue stick holder having at least one cue stick receiving aperture formed therein; and means for supporting the cue stick holder on the cue stick case for selective movement between a first orientation wherein the cue stick holder is deployed horizontally to receive a cue stick in the cue stick receiving aperture and a second storage orientation.

2. The apparatus according to claim 1 wherein the cue stick holder supporting means comprises structure supporting the cue stick holder for sliding movement relative to the cue stick case between a forced orientation in which the cue stick holder is deployed outwardly from the cue stick case to receive cue sticks through the cue stick receiving aperture thereof and a second orientation wherein the cue stick holder is contained substantially entirely within the cue stick case for storage.

3. The apparatus according to claim 1 wherein the cue stick holder supporting means supports the cue stick holder for pivotal movement between a first location wherein the cue stick holder is deployed in a normally horizontal orientation to receive cue sticks through the cue stick receiving aperture and a normally vertical storage orientation.

* * * * *